US011268539B2

(12) United States Patent
Shih

(10) Patent No.: US 11,268,539 B2
(45) Date of Patent: Mar. 8, 2022

(54) FAN DEVICE AND FAN HOLDER

(71) Applicant: Chia-Yuan Liu, Taichung (TW)

(72) Inventor: Cheng-Yi Shih, Taichung (TW)

(73) Assignee: Chia-Yuan Liu, Taichung (TW)

( * ) Notice: Subject to any disclaimer, the term of this patent is extended or adjusted under 35 U.S.C. 154(b) by 37 days.

(21) Appl. No.: 16/872,375

(22) Filed: May 12, 2020

(65) Prior Publication Data

US 2021/0355964 A1 Nov. 18, 2021

(51) Int. Cl.
*F04D 29/64* (2006.01)
*F04D 19/00* (2006.01)

(52) U.S. Cl.
CPC ..... *F04D 29/646* (2013.01); *F04D 19/002* (2013.01); *F05B 2240/91* (2013.01); *F05B 2260/30* (2013.01)

(58) Field of Classification Search
CPC ..... F04D 19/646; F04D 19/002; F04D 29/60; F05B 2240/91; F05B 2260/30; F16M 2200/02; F16M 2200/021; F16M 11/23; F16M 11/38
See application file for complete search history.

(56) References Cited

U.S. PATENT DOCUMENTS

| | | | | |
|---|---|---|---|---|
| 7,017,871 | B2 * | 3/2006 | Chen | F04D 29/601 248/161 |
| 8,734,109 | B2 * | 5/2014 | He | F04D 29/601 416/142 |
| 9,926,945 | B2 * | 3/2018 | McDonnell | F16M 11/22 |
| 2004/0037704 | A1 * | 2/2004 | Cichetti, Sr. | F04D 29/601 416/246 |
| 2009/0072108 | A1 * | 3/2009 | Oleson | F04D 25/088 248/282.1 |
| 2011/0121702 | A1 * | 5/2011 | Kofele | F25D 23/006 312/401 |
| 2013/0026333 | A1 * | 1/2013 | Wu | H05K 7/20172 248/674 |

* cited by examiner

*Primary Examiner* — Courtney D Heinle
*Assistant Examiner* — Ryan C Clark
(74) *Attorney, Agent, or Firm* — Li & Cai Intellectual Property Office

(57) ABSTRACT

A fan device and a fan holder are provided. The fan device includes the fan holder and a fan. The fan holder includes a bracket, four ratchet sets, a seat, and a frame. Each of two ends of the bracket is connected to two of the four ratchet sets. The seat is connected to the two of the four ratchet sets arranged to the one of two ends of the bracket. The frame is connected to the other two of the four ratchet sets arranged to the other one of two ends of the bracket. The seat and the frame are rotatable between a use position and a storage position relative to the bracket through the four ratchet sets. The fan is connected to the frame. The seat and the frame are rotated to the storage position, so that the bracket can be arranged on the seat.

9 Claims, 15 Drawing Sheets

1000

1000

1000

FAN DEVICE AND FAN HOLDER

FIELD OF THE DISCLOSURE

The present disclosure relates to a fan, and more particularly to a fan device and a fan holder for convenient storage.

BACKGROUND OF THE DISCLOSURE

A conventional fan device includes a fan seat and a fan that is disposed on the fan seat. The fan seat is composed of a bottom plate and a support rod that is disposed on the bottom plate. The fan is disposed on the support rod. However, the fan seat and the support rod of the conventional fan device are fixed to each other, so that the conventional fan device cannot be stored in a folded manner. As a result, when a user is not using the conventional fan device, the conventional fan device takes up space and is inconvenient for carrying.

SUMMARY OF THE DISCLOSURE

In response to the above-referenced technical inadequacies, the present disclosure provides a fan device and a fan holder to effectively improve on the issues associated with the conventional fan device.

In one aspect, the present disclosure provides a fan device, which includes a fan holder and a fan that is connected to the fan holder. The fan holder includes a bracket, four ratchet sets, a seat, and a frame. The bracket has a first end and a second end that is opposite to the first end. The four ratchet sets are disposed on the bracket. Two of the four ratchet sets are disposed on the first end of the bracket, and the other two of the four ratchet sets are disposed on the second end of the bracket. The seat is connected to the two of the four ratchet sets disposed on the first end of the bracket. The seat and the bracket have a first angle there-between. The frame is connected to the other two of the four ratchet sets disposed on the second end of the bracket. The frame and the bracket have a second angle there-between. The seat and the frame are rotatable between a use position and a storage position relative to the bracket through the four ratchet sets. When the seat and the frame are rotated relative to the bracket from the use position toward the storage position, the seat and the frame are respectively rotated relative to the bracket along two opposite directions, so that each of the first angle and the second angle is gradually reduced from a maximum degree to a minimum degree. When the seat and the frame are at the storage position, each of the first angle and the second angle is equal to or less than 10 degrees.

In one aspect, the present disclosure provides a fan holder, which includes a bracket, four ratchet sets, a seat, and a frame. The bracket has a first end and a second end that is opposite to the first end. The four ratchet sets are disposed on the bracket. Two of the four ratchet sets are disposed on the first end of the bracket, and the other two of the four ratchet sets are disposed on the second end of the bracket. The seat is connected to the two of the four ratchet sets disposed on the first end of the bracket. The seat and the bracket have a first angle there-between. The frame is connected to the other two of the four ratchet sets disposed on the second end of the bracket. The frame and the bracket have a second angle there-between. The seat and the frame are rotatable between a use position and a storage position relative to the bracket through the four ratchet sets. When the seat and the frame are rotated relative to the bracket from the use position toward the storage position, the seat and the frame are respectively rotated relative to the bracket along two opposite directions, so that each of the first angle and the second angle is gradually reduced from a maximum degree to a minimum degree. When the seat and the frame are at the storage position, each of the first angle and the second angle is equal to or less than 10 degrees.

Therefore, the fan device and the fan holder of the present disclosure include the seat and the frame being rotatable relative to the bracket between the use position and the storage position. A user can rotate the seat and the frame to the storage position, so that the bracket is folded on the seat and the frame is folded on the bracket. Accordingly, the volume of the fan device (or the fan holder) is reduced so as to enable convenient storage and carrying thereof.

These and other aspects of the present disclosure will become apparent from the following description of the embodiment taken in conjunction with the following drawings and their captions, although variations and modifications therein may be affected without departing from the spirit and scope of the novel concepts of the disclosure.

BRIEF DESCRIPTION OF THE DRAWINGS

The present disclosure will become more fully understood from the following detailed description and accompanying drawings.

DETAILED DESCRIPTION OF THE EXEMPLARY EMBODIMENTS

Figure 1:
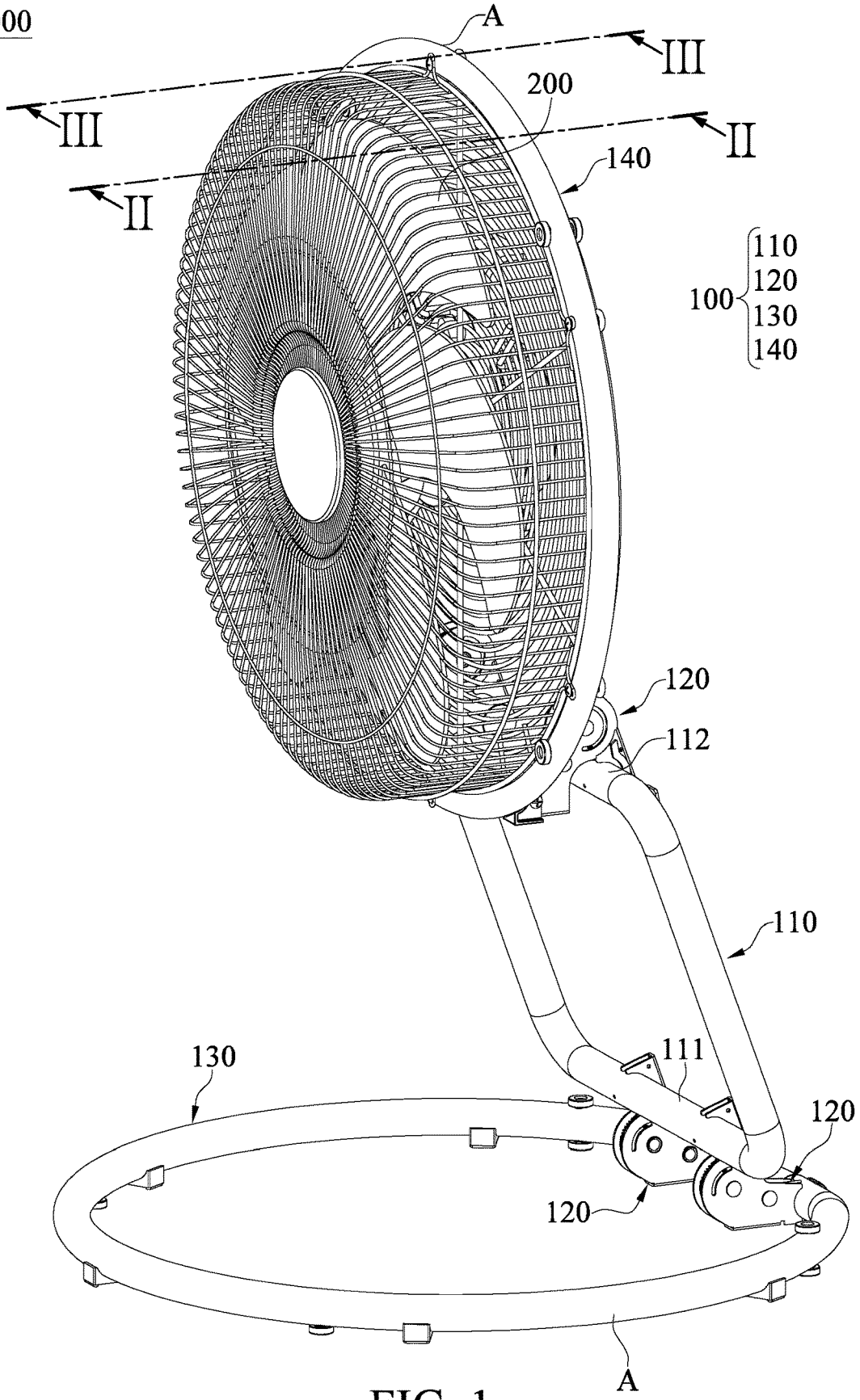
FIG. 1 is a perspective view of a frame and a seat of a fan device according to a first embodiment of the present disclosure at a use position.

The present disclosure is more particularly described in the following examples that are intended as illustrative only since numerous modifications and variations therein will be apparent to those skilled in the art. Like numbers in the drawings indicate like components throughout the views. As used in the description herein and throughout the claims that follow, unless the context clearly dictates otherwise, the meaning of "a", "an", and "the" includes plural reference, and the meaning of "in" includes "in" and "on". Titles or subtitles can be used herein for the convenience of a reader, which shall have no influence on the scope of the present disclosure.

The terms used herein generally have their ordinary meanings in the art. In the case of conflict, the present document, including any definitions given herein, will prevail. The same thing can be expressed in more than one way. Alternative language and synonyms can be used for any term(s) discussed herein, and no special significance is to be placed upon whether a term is elaborated or discussed herein. A recital of one or more synonyms does not exclude the use of other synonyms. The use of examples anywhere in this specification including examples of any terms is illustrative only, and in no way limits the scope and meaning of the present disclosure or of any exemplified term. Likewise, the present disclosure is not limited to various embodiments given herein. Numbering terms such as "first", "second" or "third" can be used to describe various components, signals or the like, which are for distinguishing one component/signal from another one only, and are not intended to, nor should be construed to impose any substantive limitations on the components, signals or the like.

First Embodiment

Referring to FIG. 1 to FIG. 13, a first embodiment of the present disclosure provides a fan device 1000 that can be stored in a folded manner to achieve the effect of reducing volume. In other words, any fan device that cannot be stored in a folded manner is not the fan device 1000 of the present disclosure, such as a fan device stored in a detached manner. The fan device 1000 includes a fan holder 100 and a fan 200 that is disposed on the fan holder 100.

It should be noted that the fan holder 100 and the fan 200 in the present embodiment are jointly defined as the fan device 1000, but the present disclosure is not limited thereto. For example, the fan holder 100 can be independently used (e.g., sold) or can be used in cooperation with other components. The following description describes the structure and connection relationship of each component of the fan device 1000.

The fan holder 100 includes a bracket 110, four ratchet sets 120 disposed on the bracket 110, a seat 130 disposed on two of the four ratchet sets 120, and a frame 140 that is disposed on the other two of the four ratchet sets 120. Specifically, the fan holder 100 can be folded to reduce the volume of the fan device 1000 for storage by having the four ratchet sets 120. That is to say, any fan holder that cannot be store by a ratchet structure is not the fan holder 100 of the present disclosure.

Figure 2:
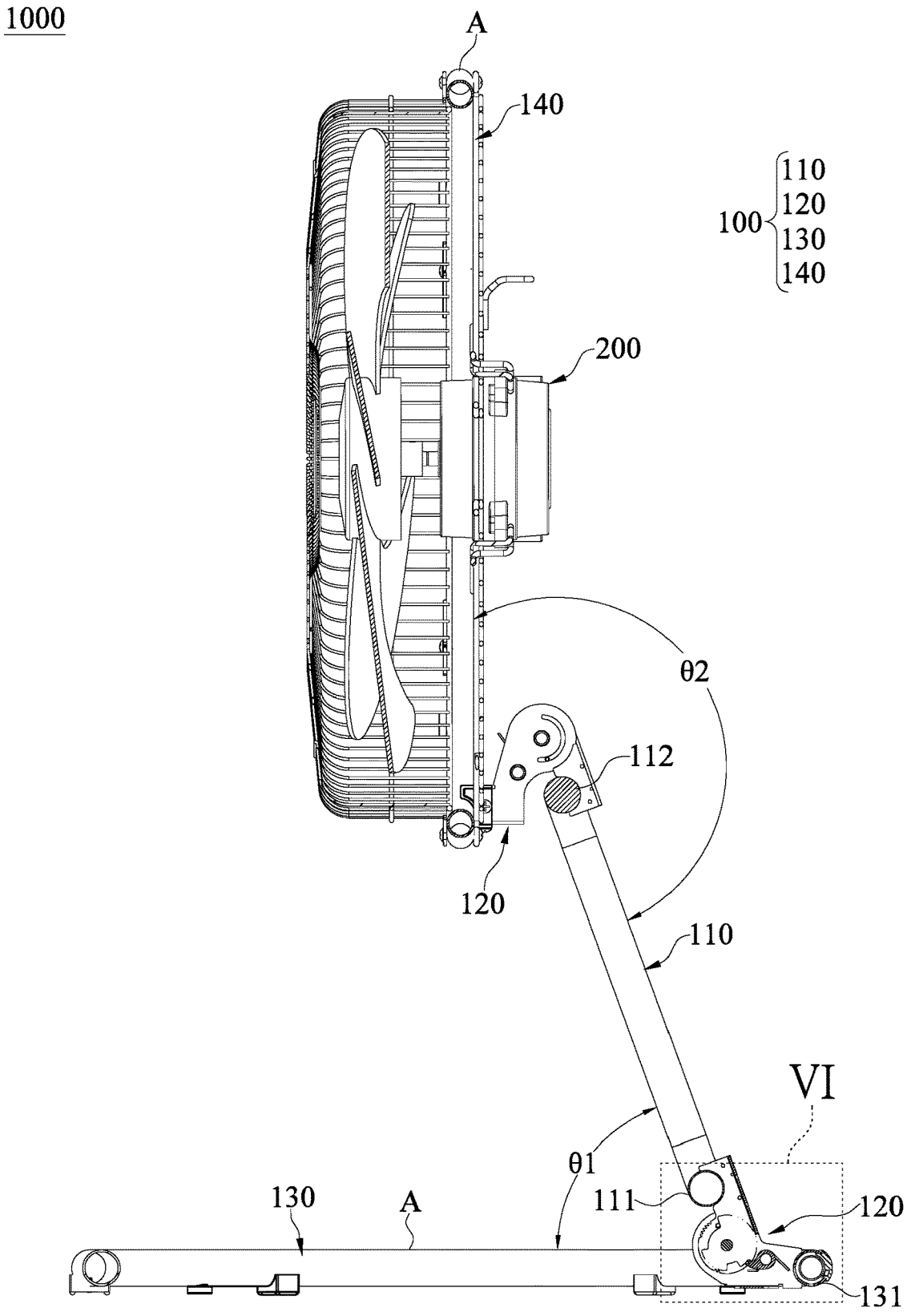
FIG. 2 is a cross-sectional view taken along line II-II of FIG. 1.
Figure 3:
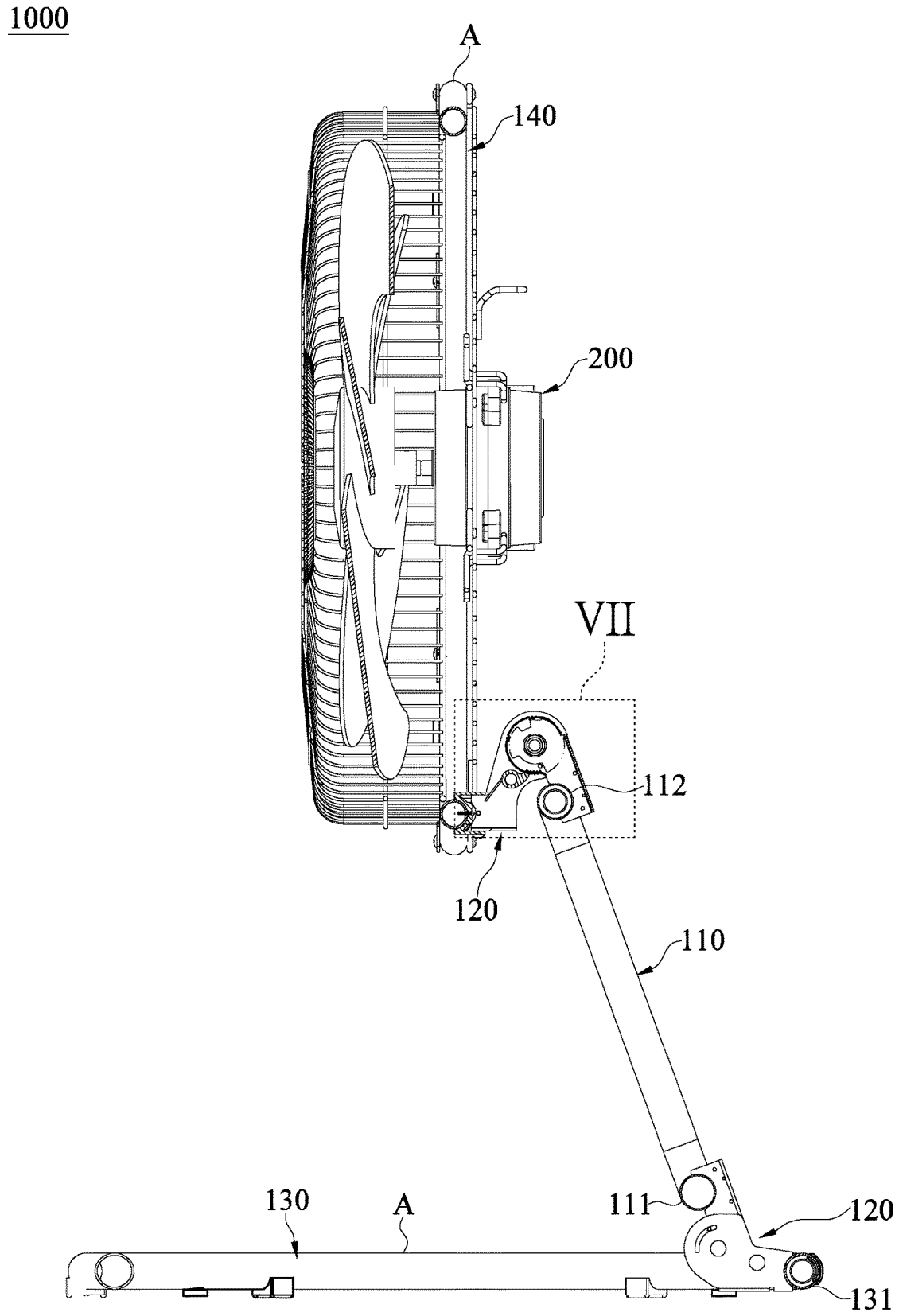
FIG. 3 is a cross-sectional view taken along line III-III of FIG. 1.
Figure 4:
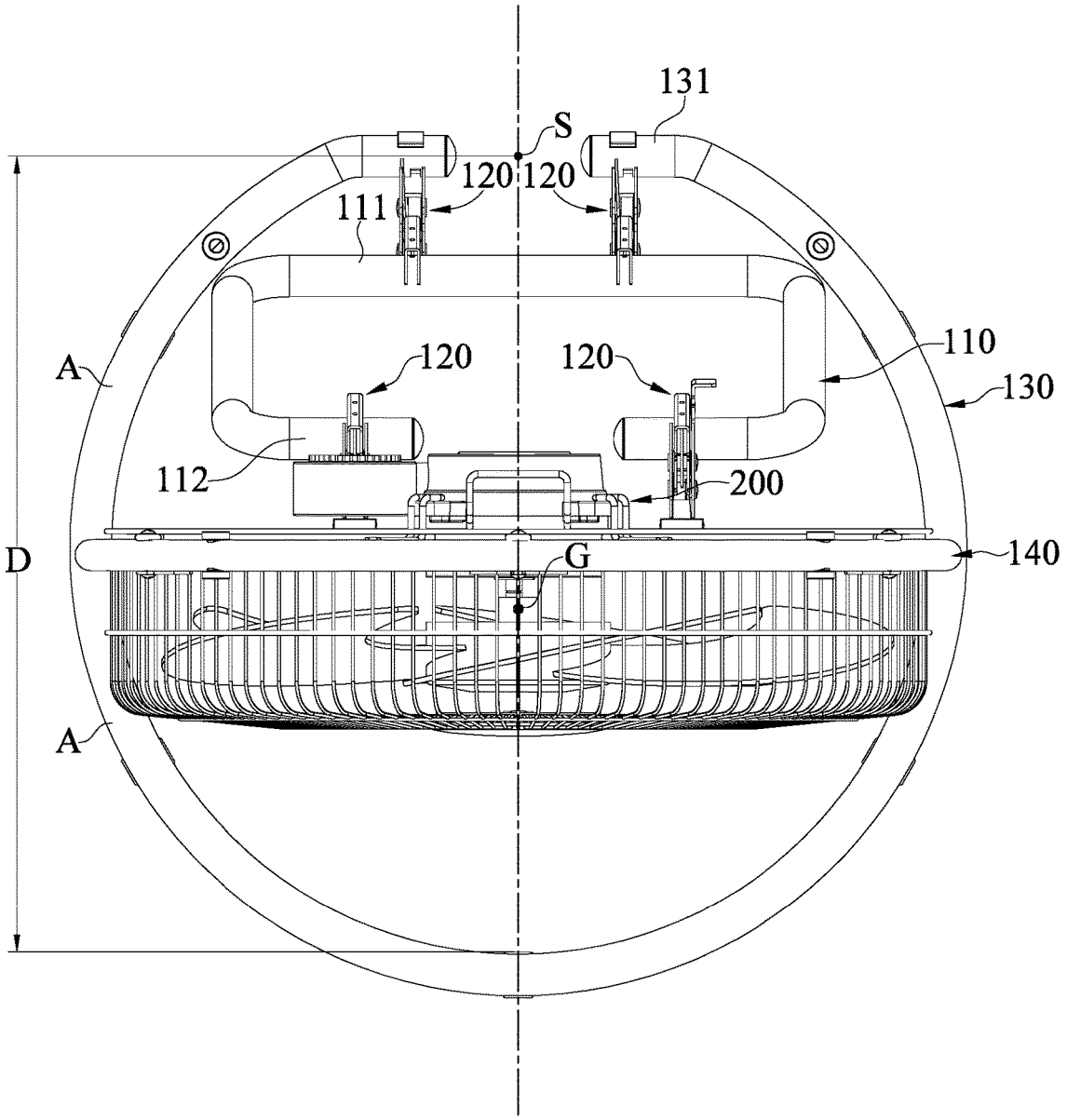
FIG. 4 is a top view of the frame and the seat of the fan device according to the first embodiment of the present disclosure at the use position.

Referring to FIG. 2 to FIG. 4, the bracket 110 is a rectangular ring frame structure in the present embodiment, and has a first end 111 and a second end 112 that is opposite to the first end 111. The two of the four ratchet sets 120 are disposed on the first end 111, and the other two of the four ratchet sets 120 are disposed on the second end 112.

Figure 5:
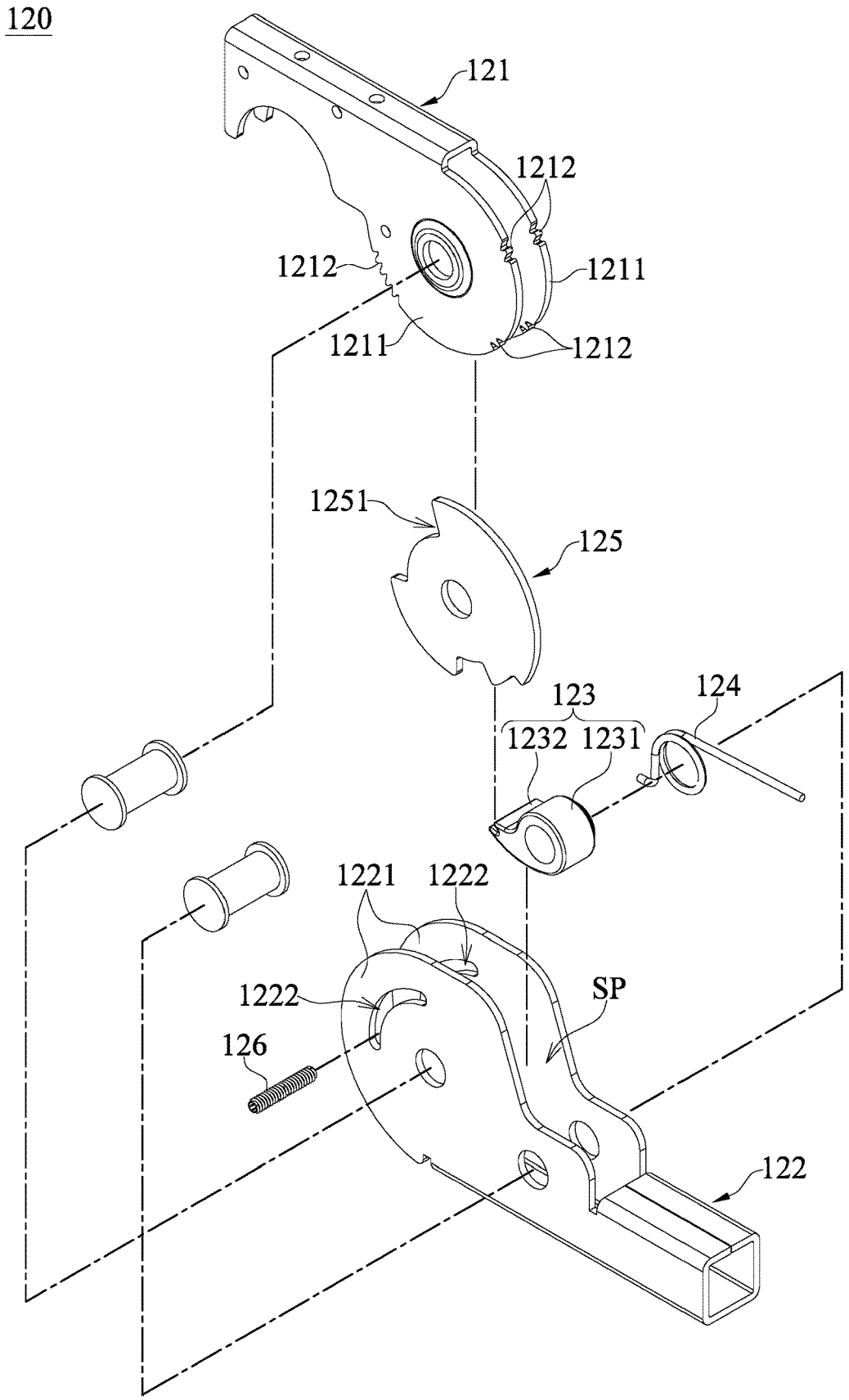
FIG. 5 is an exploded view of a ratchet set of the fan device according to the first embodiment of the present disclosure.
Figure 6:
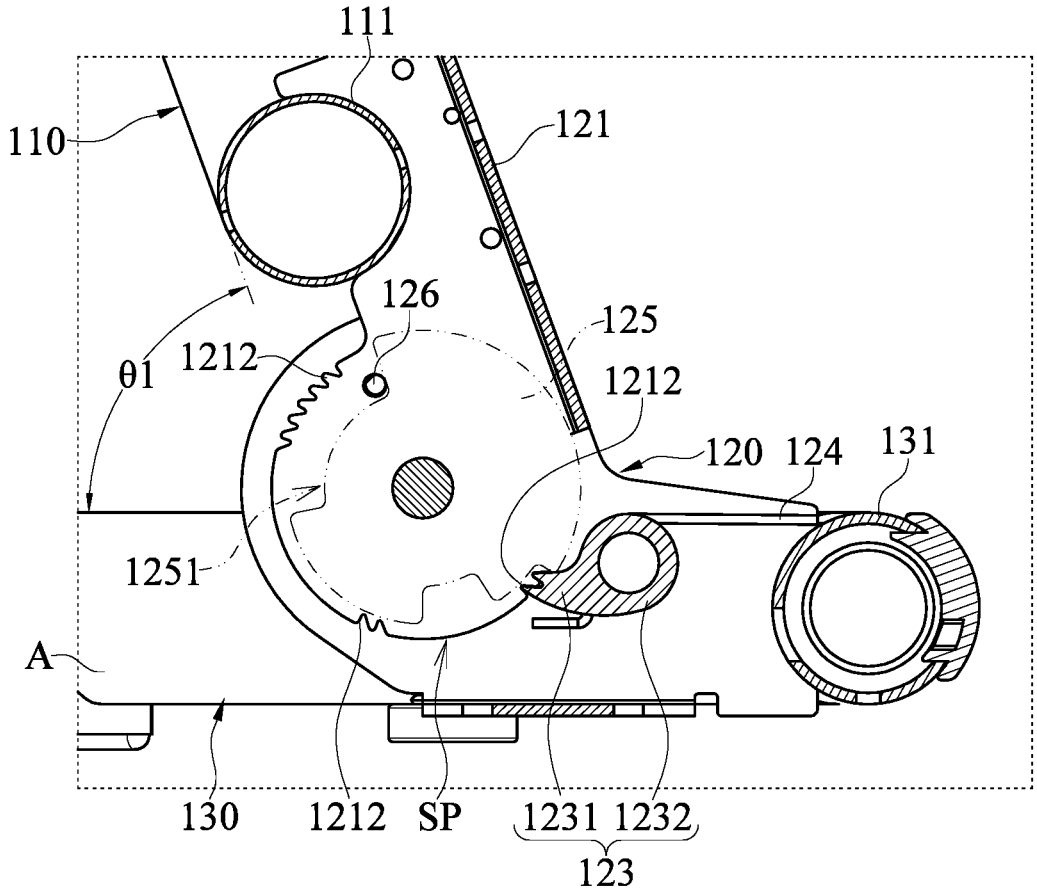
FIG. 6 is an enlarged view showing section VI of FIG. 2.
Figure 7:
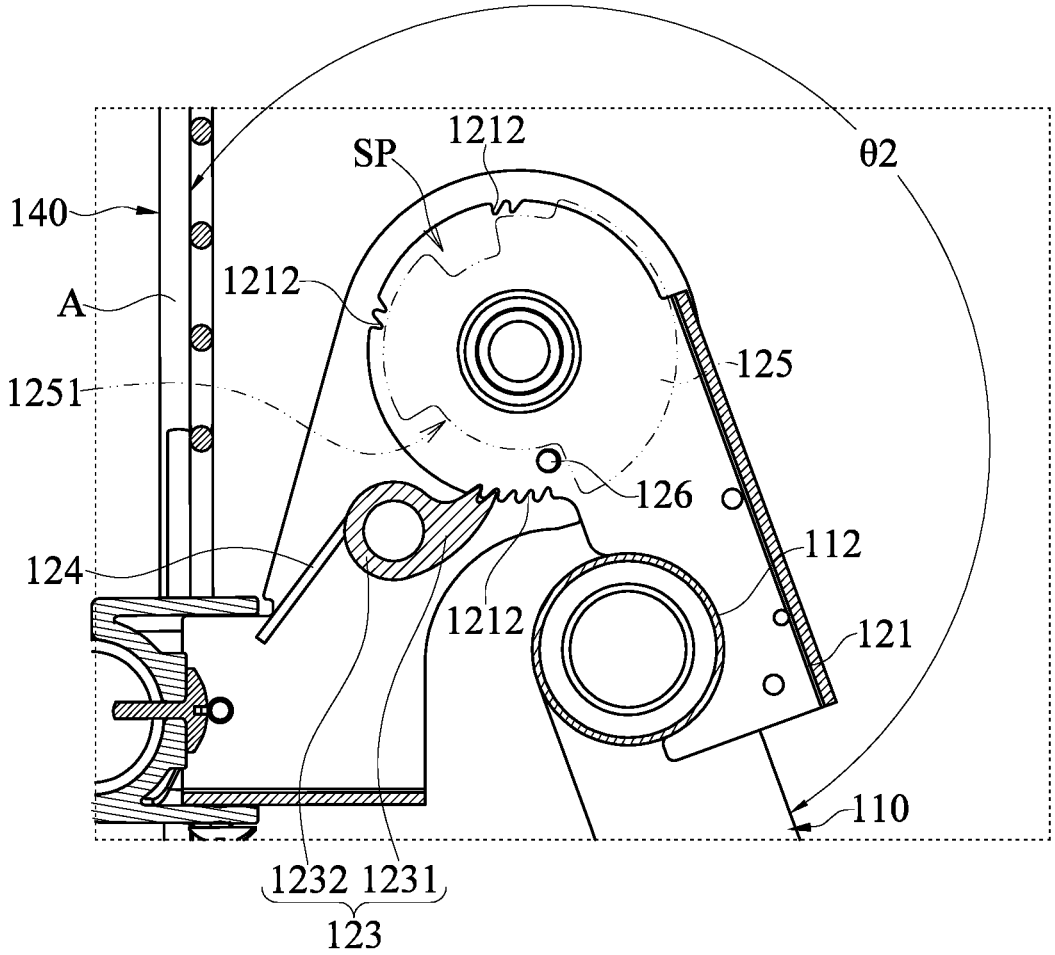
FIG. 7 is an enlarged view showing section VII of FIG. 3.

Referring to FIG. 5 to FIG. 7, each of the four ratchet sets 120 includes an abutment 121 disposed on the bracket 110, a fastener 122 disposed on the abutment 121, a gear 123 disposed on the fastener 122, a torsion spring 124 disposed on the fastener 122, a stop sheet disposed on the fastener 122, and a limiting rod 126 that is disposed on the abutment 121.

Referring to FIG. 6, FIG. 7, FIG. 11, and FIG. 12, in each of the four ratchet sets 120, the abutment 121 has two ends. One of the two ends of the abutment 121 is fixed to the bracket 110, and the other one of the two ends of the abutment 121 includes two abutting plates 1211 that are of circular shape. An outer edge of the two abutting plates 1211 of each of the abutments 121 has a plurality of single row ratchets. The tooth (i.e., coggings) of the single row ratchets 1212 are skewed relative to the diameter (or radius) of the two abutting plates 1211.

In each of the four ratchet sets 120, the fastener 122 has two ends, one of the two ends of the fastener 122 is pivotally connected to the abutment 121, and the other one of the two ends of the fastener 122 is connected to the seat 130 or the frame 140. Specifically, the one of the two ends of the fastener 122 has two fixing plates 1221. The two fixing plates 1221 are spaced apart from each other by a distance, so that the fastener 122 forms a accommodating space SP. The abutment 121 is located in the accommodating space SP and is pivotally connected to the fastener 122. Each of the two fixing plates 1221 of the fastener 122 has a sliding groove 1222, and the two sliding grooves 1222 are arc-shaped and symmetrical to each other.

In each of the four ratchet sets 120, the gear 123 is arranged in the accommodating space SP and is pivotally connected to the fastener 122. The gear 123 has a teeth end 1231 that is configured to be engaged with any one of the single row ratchets 1212. Specifically, the gear 123 has a body 1232 having a cylindrical shape and the teeth end 1231 that is connected to the body 1232. The teeth end 1231 can be used in cooperation with the single row ratchets 1212 and latched in one direction therewith.

In each of the four ratchet sets 120, the torsion spring 124 is arranged in the accommodating space SP. The torsion spring 124 has two ends. One of the two ends of the torsion spring 124 abuts on the fastener 122, and the other one of the two ends of the torsion spring 124 is hooked on the teeth end 1231 of the gear 123. The torsion spring 124 springs against the gear 123, so that the teeth end 1231 of the gear 123 unidirectionally latches onto any one of the single row ratchets 1212. It should be noted that the one of the two ends of the torsion spring 124 is abutted against the fastener 122 in the present embodiment. However, in other embodiments of the present disclosure, the one of the two ends of the torsion spring 124 may be abutted against the seat 130 or the frame 140.

In each of the four ratchet sets 120, the stop sheet 125 of each of the four ratchets sets 120 is arranged in the accommodating space SP and is pivotally connected to the fastener 122. A notch 1251 is formed on an outer edge of the stop sheet 125, and the two sliding grooves 1222 correspond in position to the notch 1251. In other words, the notch 1251 in the present embodiment is arc-shaped and has an arc length. The arc length of the notch 1251 is smaller than the arc length of the two sliding grooves 1222, but the present disclosure is not limited thereto. For example, the arc length of the notch 1251 may be greater than or equal to the arc length of the two sliding grooves 1222.

In each of the four ratchet sets 120, two ends of the limiting rod 126 are respectively located in and slidable along the two sliding grooves 1222. Further, when the limiting rod 126 moves and approaches both ends of the two sliding grooves 1222, the limiting rod 126 is abutted against the inner edge of the notch 1251 of the stop sheet 125. That is to say, the stop sheet 125 is configured to limit the rotation degree of the abutment 121 relative to the fastener 122.

The seat 130 is connected to the two of the four ratchet sets 120 disposed on the first end 111 of the bracket 110. The seat 130 and the bracket 110 have a first angle θ1 there-between. Specifically, the seat 130 is a circular ring frame structure and has an opening, so that the seat 130 is formed with two end portions 131. The two end portions 131 each have a connection hole 1311, and the two connection holes 1311 are connected to the fastener 122 of the two of the four ratchet sets 120 disposed on the first end 111. A middle position on an outer edge of the seat 130 and arranged between the two end portions 131 is defined as a starting point S. A distance from the starting point S to a farthest point on an inner edge of the seat 130 is defined as a predetermined distance D.

The frame 140 is connected to the two of the four ratchet sets 120 disposed on the second end 112 of the bracket 110. The frame 140 and the bracket 110 have a second angle θ2 there-between. The fan 200 is disposed on the frame 140 and has a center of gravity. Specifically, the frame 140 is a circular ring frame structure. One end of the frame 140 is connected to the fastener 122 of the two of the four ratchet sets 120 disposed on the second end 112 of the bracket 110.

Figure 9:
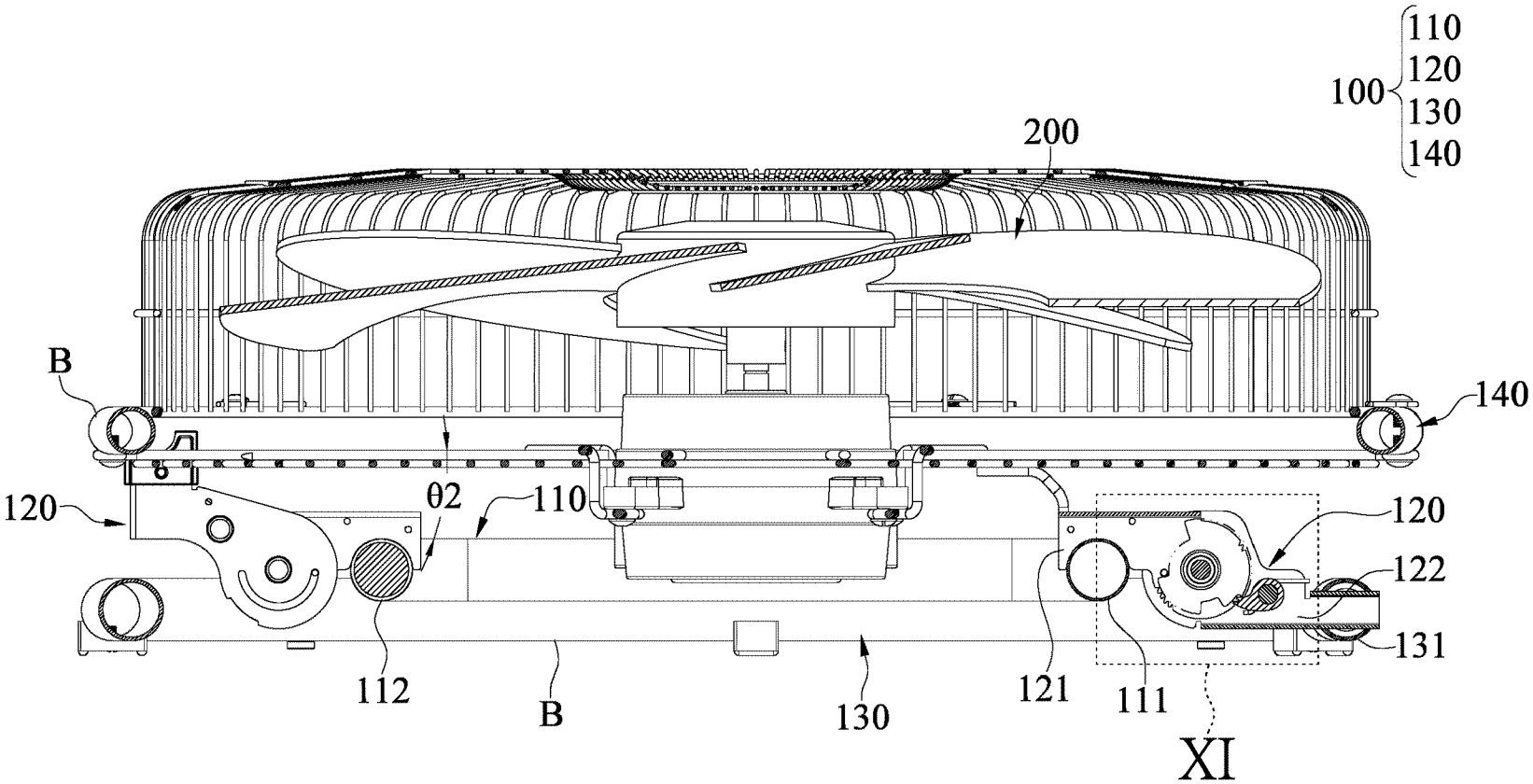
FIG. 9 is a cross-sectional view taken along line IX-IX of FIG. 8.

The seat 130 and the frame 140 are rotatable between a use position A (as shown in FIG. 2) and a storage position B (as shown in FIG. 9) relative to the bracket 110 through the four ratchet sets 120. When the seat 130 and the frame 140 are rotated relative to the bracket 110 from the use position A toward the storage position B, the seat 130 and the frame 140 are respectively rotated relative to the bracket 110 along two opposite directions, so that each of the first angle θ1 and the second angle θ2 is gradually reduced from a maximum degree to a minimum degree. Further, when the seat 130 and the frame 140 are rotated by the four ratchet sets 120, the gear 123 of each of the four ratchet sets 120 may latch with the single row ratchets 1212 in one direction. That is to say, the maximum degree and the minimum degree correspond to the number or angle of the single row ratchets 1212. In the present embodiment, a range of the maximum degree to the minimum degree of the first angle θ1 is 0 to 70 degrees, and a range of the maximum degree to the minimum degree of the second angle θ2 is 0 to 165 degrees, but the present disclosure is not limited thereto. The cooperation relationship between the stop sheet 125 and the limiting rod 126 of each of the four ratchet sets 120 further limits the seat 130 and the frame 140 to being able to rotate only between the use position A and the storage position B.

Preferably, referring in FIG. 4, when the seat 130 and the frame 140 are at the use position A, an orthographic projection of a position of the center of gravity of the fan 200 on the seat 130 is defined as a projection point G The distance between the starting point S and the projection point G is equal to or less than ¾ of the predetermined distance D.

Figure 8:
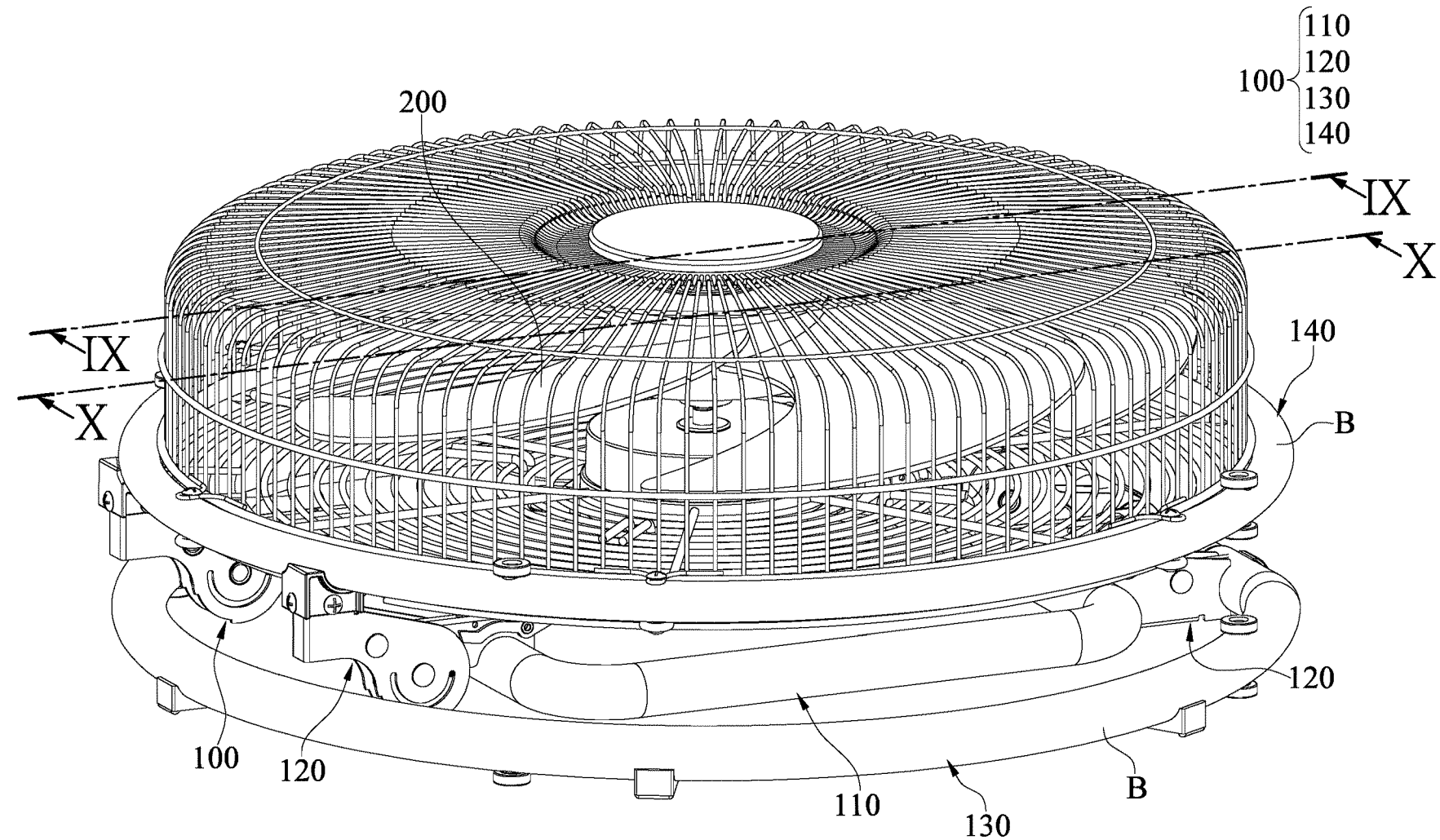
FIG. 8 is a perspective view of the frame and the seat of the fan device according to the first embodiment of the present disclosure at a storage position.
Figure 10:
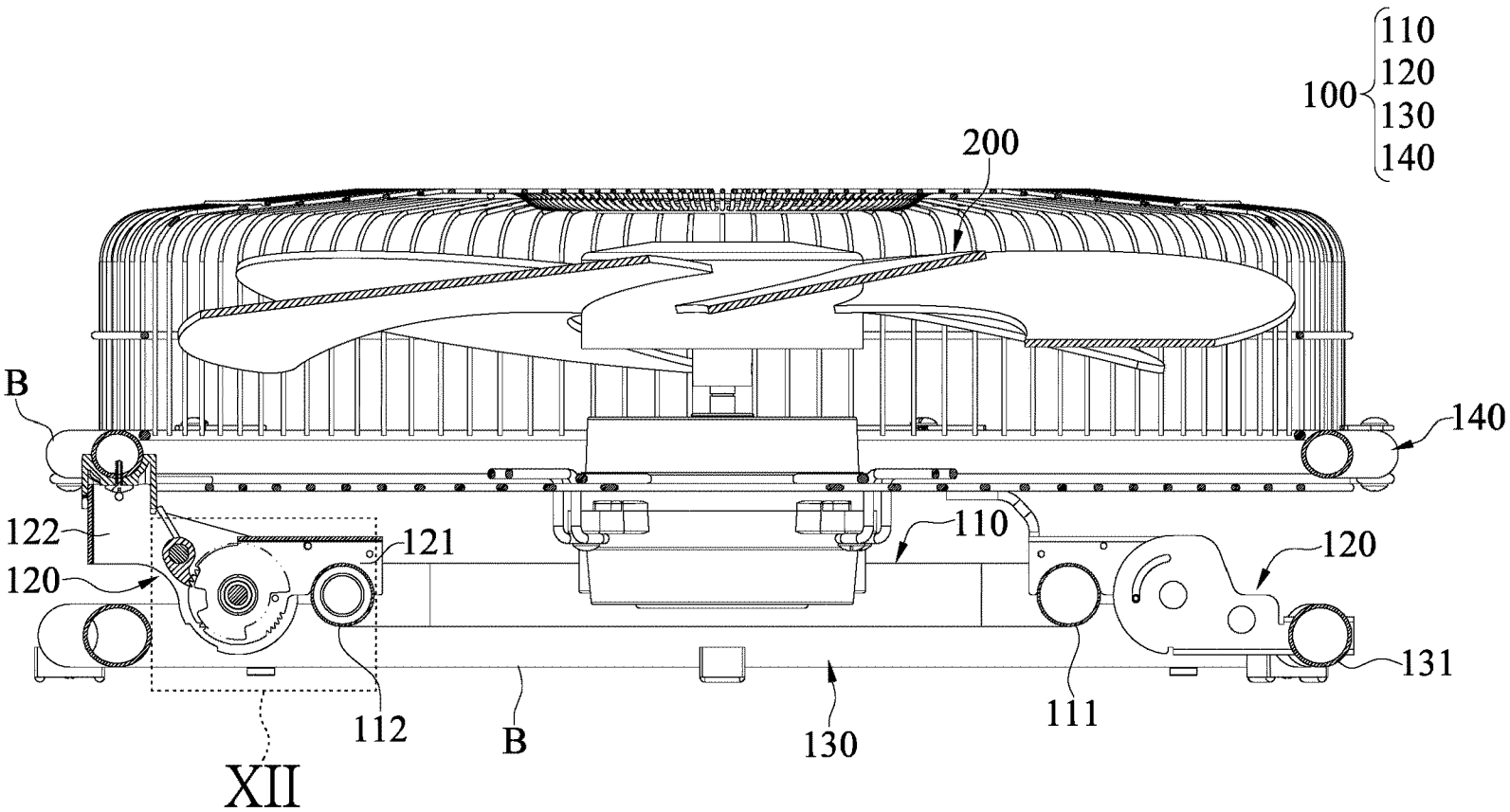
FIG. 10 is a cross-sectional view taken along line X-X of FIG. 8.
Figure 11:
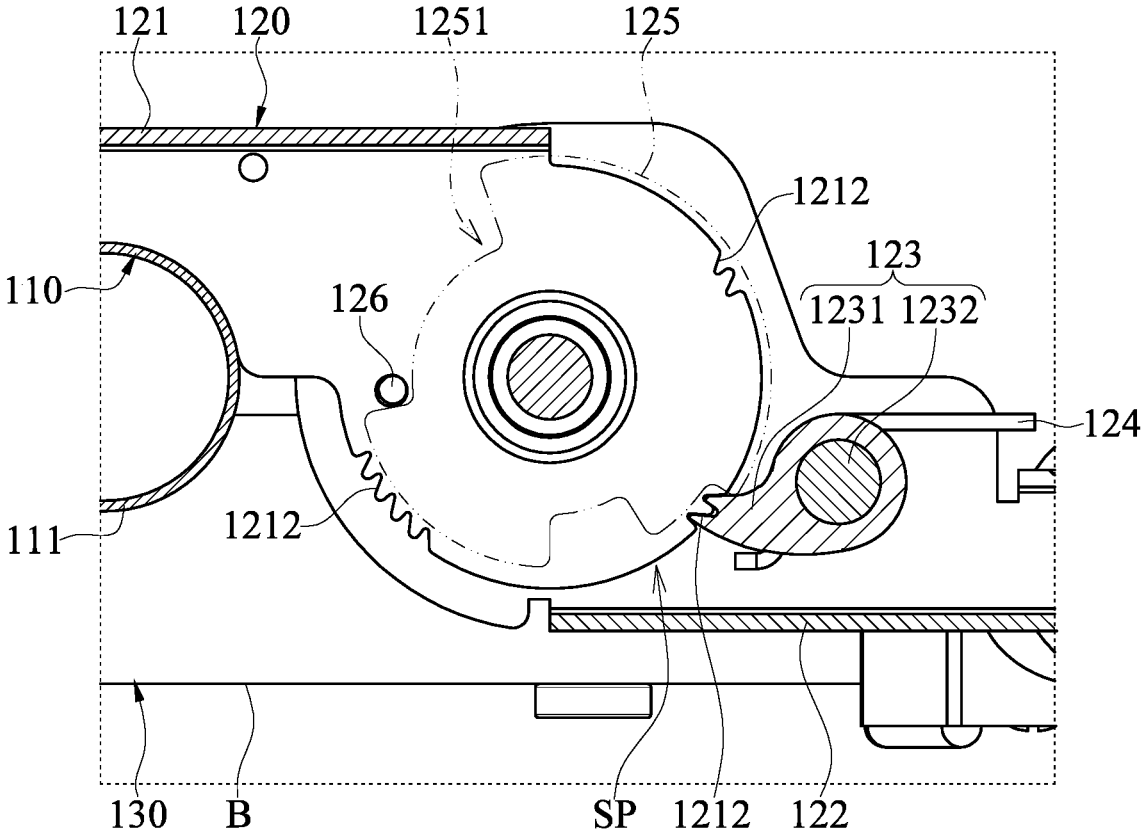
FIG. 11 is an enlarged view showing section XI of FIG. 9.
Figure 12:
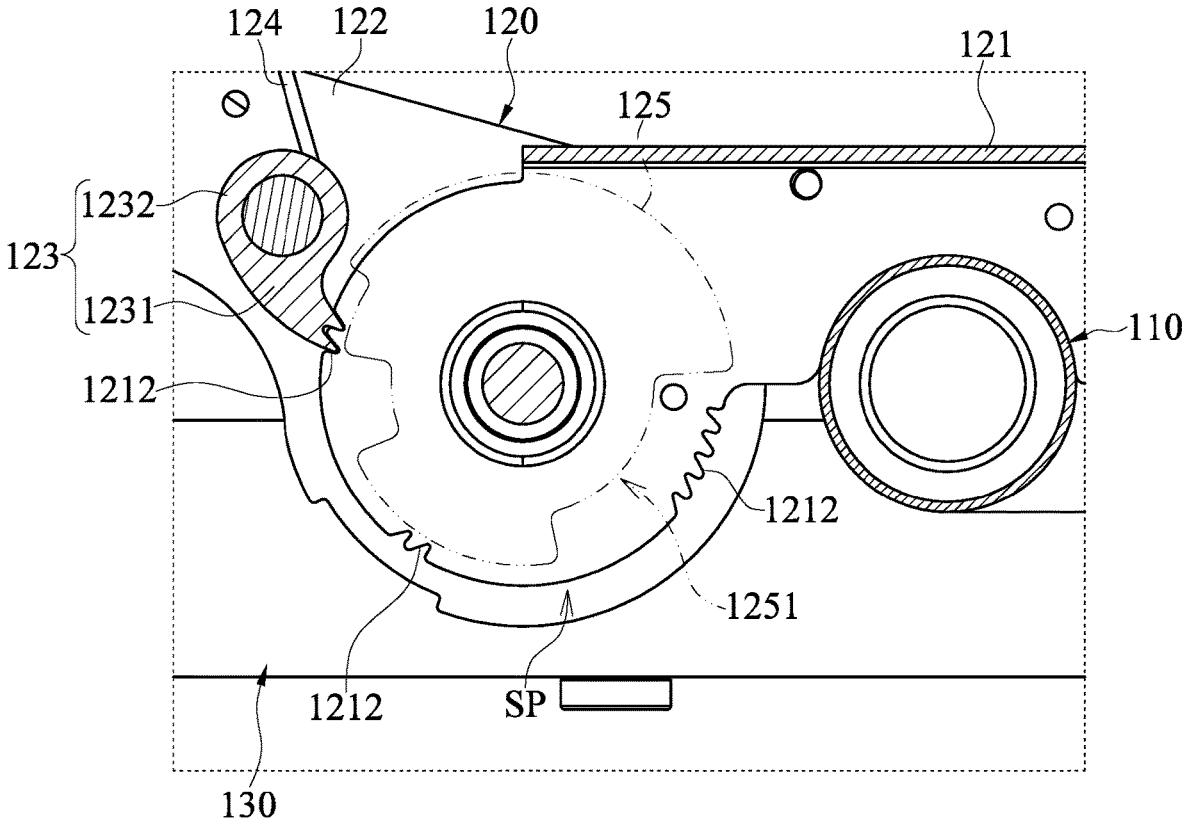
FIG. 12 is an enlarged view showing section XII of FIG. 10.

Referring to FIG. 8 to FIG. 10, when the seat 130 and the frame 140 are at the storage position B, each of the first angle θ1 and the second angle θ2 is equal to or less than 10 degrees. It should be noted that, in the present embodiment, the frame 140 in FIG. 9 and FIG. 10 is located at a position surrounded by the seat 130 (that is, view of the frame 140 is obstructed by the seat 130 in the cross-sectional views). Therefore, the first angle θ1 of FIG. 9 and FIG. 10 is 0 degrees and is not labeled.

Figure 13:
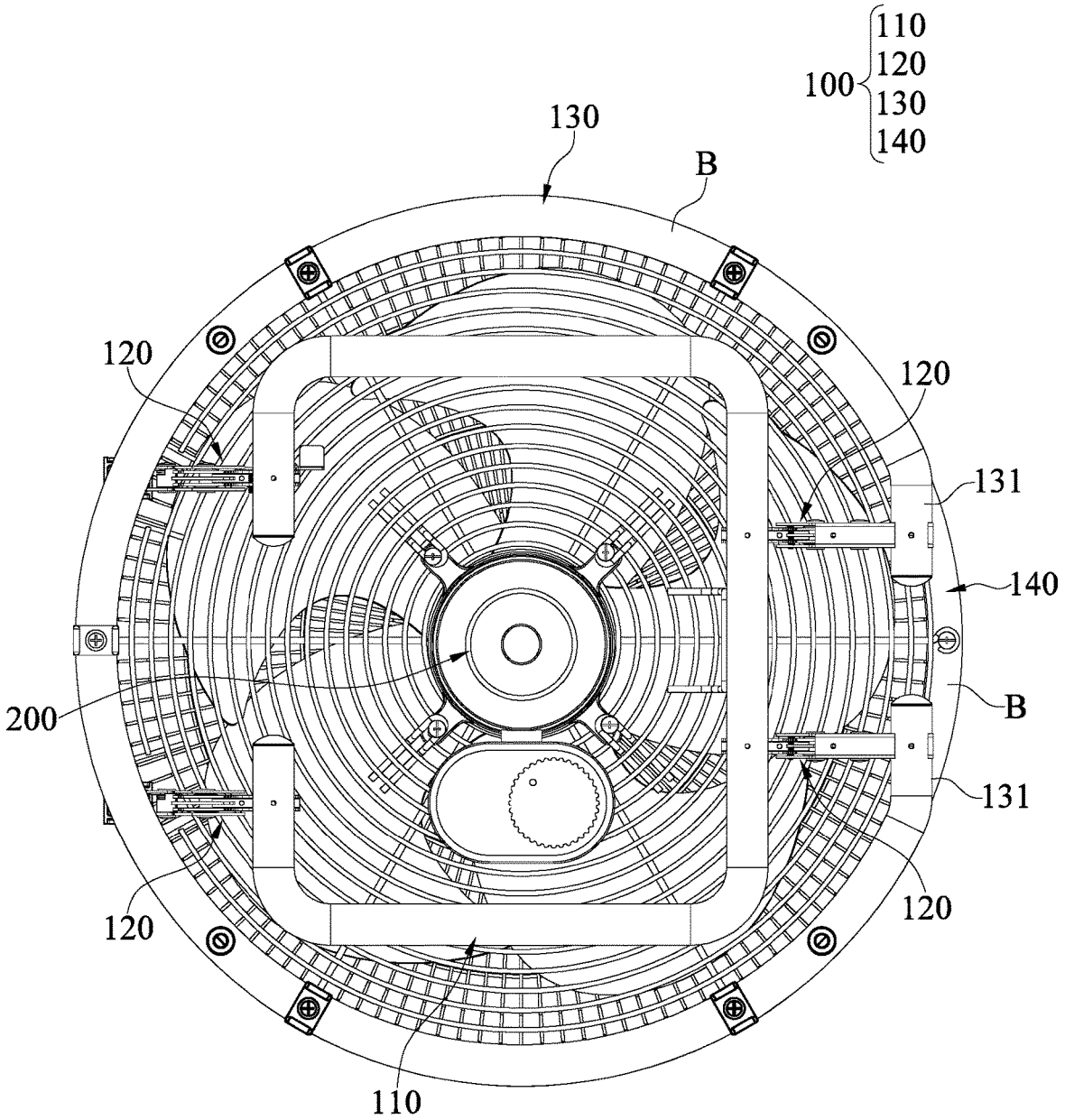
FIG. 13 is a top view of the frame and the seat of the fan device of the present disclosure at the storage position.

The bracket 110 is capable of folding on the seat 130, and the frame 140 is capable of folding on the bracket 110. In other words, when the frame 140 and the bracket 130 are at the storage position B, a first projection region defined by orthogonally projecting the frame 140 onto the seat 130 has an outer contour that is substantially overlapped with an outer contour of the seat 130, and a second projection region defined by orthogonally projecting the bracket 110 onto the seat 130 has an outer contour that is arranged inside of the outer contour of the seat 130 (as shown in FIG. 13). That is to say, the diameters of the frame 140 and the seat 130 are the same in the present embodiment, but the present disclosure is not limited thereto.

It should be noted that, the seat 130 and the frame 140 are rotated relative to the bracket 110 through the four ratchet sets 120. That is to say, a user can adjust the seat 130 and the frame 140 between the use position A and the storage position B according to practical requirements. For example, the user can individually rotate the frame 140 between the maximum degree and the minimum degree of the second angle θ2 to adjust the position towards which the fan 200 blows, or the user can individually rotate the seat 130 between the maximum degree and the minimum degree of the first angle θ1 to adjust the height position of the fan 200 relative to that of the seat 130.

Second Embodiment

Figure 14:
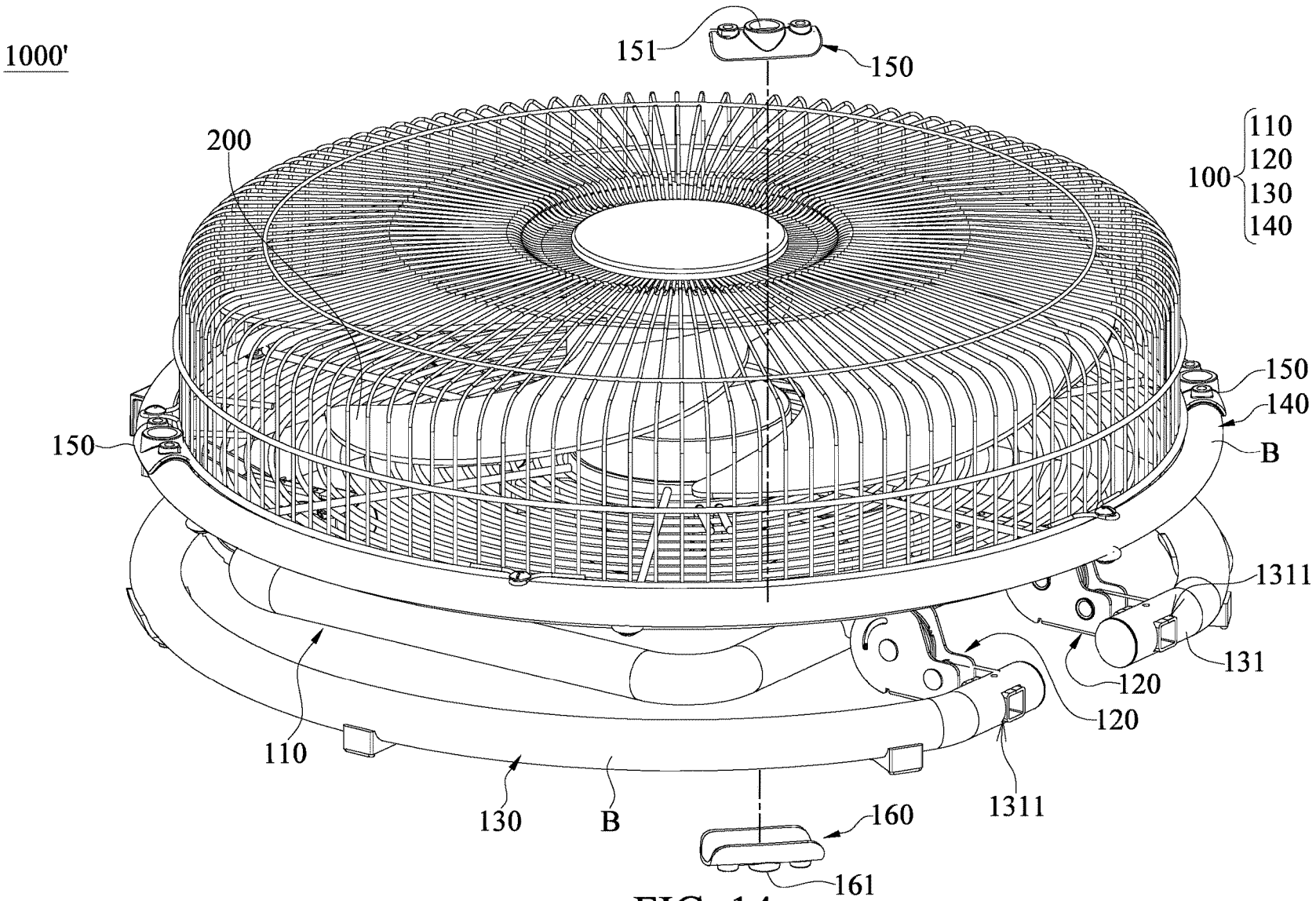
FIG. 14 is an exploded view of the frame and the seat set of the fan device according to a second embodiment of the present disclosure at the storage position.
Figure 15:
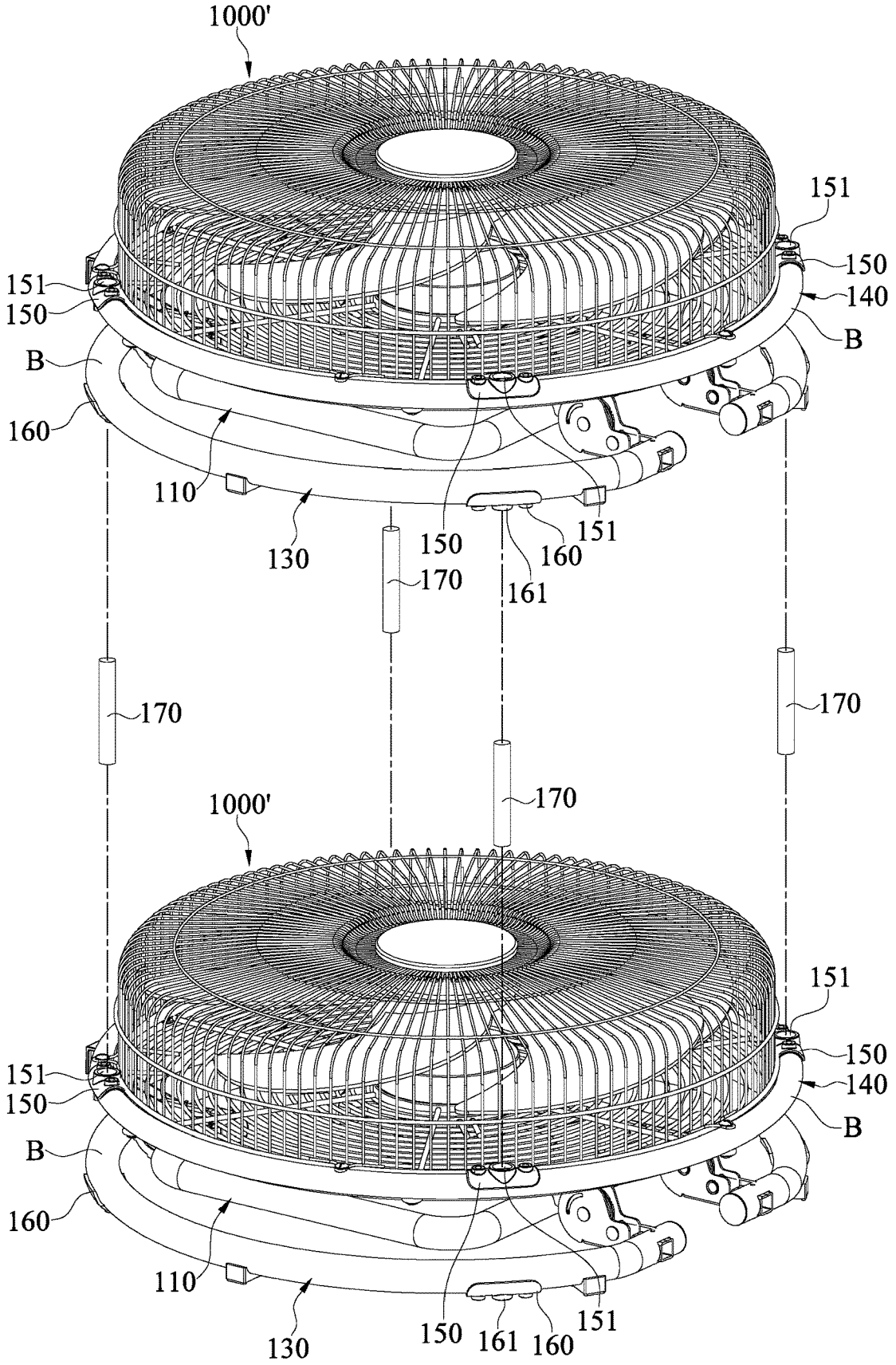
FIG. 15 is a perspective view of the fan device according to the second embodiment of the present disclosure connects to another fan device of the present disclosure.

Referring to FIG. 14 and FIG. 15, the greatest difference between the second embodiment and the first embodiment is that the fan holder 100 further includes a plurality of first connection members 150, a plurality of second connection members 160, and a plurality of support rods 170. The first connection members 150 are disposed on the frame 140, and each of the first connection members 150 includes a first connection groove 151 capable of being connected to any one of the support rods 170. The second connection members 160 are disposed on the seat 130, and each of the second connection members 160 includes a second connection groove 161 capable of being connected to any one of the support rods 170. Specifically, the number of the first connection members 150, the second connection members 160, and the support rods 170 in the present embodiment are the same. When the frame 140 and the bracket 110 are at the storage position B, the positions of the first connection members 150 respectively correspond to the positions of the second connection members 160. Each of the first connection grooves 151 faces away from the seat 130 (e.g., the first connection grooves 151 face upward in FIG. 13), and each of the second connection grooves 161 faces away from the frame 140 (e.g., the second connection grooves 161 face downward in FIG. 13).

In order to more clearly describe the present embodiment, an example is provided in the following: when the user does not need to use the two fan devices 1000' of the present embodiment (as shown in FIG. 15), the user can rotate the seat 130 and the frame 140 of each of the two fan devices 1000' to the storage position B. The support rods 170 are assembled on the first connection members 150 of one of the two fan devices 1000'. Next, the other one of the two fan devices 1000' is connected with the second connecting members 160 and the support rods 170, so that the two fan devices 1000' are in a top and bottom arrangement, but are not limited to the assembly sequence disclosed in the present embodiment. For example, the supporting rods 170 may also first be assembled on the second connection members 160 of one of the two fan devices 1000', and then the other one of the two fan device 1000' may next be assembled with the first connecting members 150 and the supporting rods 170.

In conclusion, the fan device 1000 and the fan holder 100 of the present disclosure include the seat 130 and the frame 140 being rotatable relative to the bracket 110 between the use position A and the storage position B. The user can rotate the seat 130 and the frame 140 to the storage position B, so that the bracket 110 is folded on the seat 130 and the frame 140 is folded on the bracket 110. Accordingly, the volume of the fan device 1000 (or the fan holder 100) is reduced so as to enable convenient storage and carrying thereof.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to enable others skilled in the art to utilize the disclosure and various embodiments and with various modifications as are suited to the particular use contemplated. Alternative embodiments will become apparent to those skilled in the art to which the present disclosure pertains without departing from its spirit and scope.

What is claimed is:

1. A fan device, comprising: a fan holder including: a bracket having a first end and a second end that is opposite to the first end; four ratchet sets disposed on the bracket, wherein two of the four ratchet sets are disposed on the first end of the bracket, and the other two of the four ratchet sets are disposed on the second end of the bracket; a seat connected to the two of the four ratchet sets disposed on the first end of the bracket, wherein the seat and the bracket have a first angle there-between; and a frame connected to the other two of the four ratchet sets disposed on the second end of the bracket, wherein the frame and the bracket have a second angle there-between, wherein the seat and the frame are rotatable between a use position and a storage position relative to the bracket through the four ratchet sets, wherein when the seat and the frame are rotated relative to the bracket from the use position toward the storage position, the seat and the frame are respectively rotated relative to the bracket along two opposite directions, so that each of the first angle and the second angle is gradually reduced from a maximum degree to a minimum degree, and wherein when the seat and the frame are at the storage position, each of the first angle and the second angle is equal to or less than 10 degrees; wherein each of the four ratchet sets includes: an abutment having two ends, wherein one of the two ends of the abutment is disposed on the bracket, and an outer edge of the other one of the two ends of the abutment has a plurality of single row ratchets, a fastener having two ends, wherein one of the two ends of the fastener has an accommodating space and is pivotally connected to the abutment that is accommodated in the accommodating space, and wherein the other one of the two ends of the fastener is connected to the seat or the frame, a gear arranged in the accommodating space and pivotally connected to the fastener, wherein the gear has a teeth end that is configured to be engaged with any one of the single row ratchets, and a torsion spring arranged in the accommodating space and pivotally connected to the fastener, wherein the torsion spring has two ends, wherein one of the two ends of the torsion spring abuts on the fastener, and the other one of the two ends of the torsion springs is hooked on the teeth end, and wherein the torsion spring pushes against the gear, so that the teeth end of the gear unidirectionally latches onto any one of the single row ratchets, and a fan connected to the frame.

2. The fan device according to claim 1, wherein each of the four ratchet sets further includes a stop sheet and a limiting rod that is fixed on the abutment, wherein the stop sheet of each of the ratchet sets is arranged in the space and pivotally connected to the fastener, wherein in each of the four ratchet sets, a notch is formed on an outer edge of the stop sheet, wherein each of the fasteners has two sliding grooves opposite to each other, and the two sliding grooves correspond in position to the notch, and wherein in each of the four ratchet sets, two ends of the limiting rod are respectively located in and slidable along the two sliding grooves, so that the seat and the frame are rotatable relative to the bracket between the use position and the storage position.

3. The fan device according to claim 1, wherein each of the frame and the seat is a circular ring structure, and wherein when the frame and the bracket are at the storage position, a first projection region defined by orthogonally projecting the frame onto the seat has an outer contour that is substantially overlapped with an outer contour of the seat, and a second projection region defined by orthogonally projecting the bracket onto the seat has an outer contour that is arranged inside of the outer contour of the seat.

4. The fan device according to claim 1, wherein the fan includes a center of gravity, wherein the seat and the frame are at the use position, an orthographic projection of a position of the center of gravity on the seat is defined as a projection point, wherein a middle position of the seat arranged between two of the four ratchet sets is defined as a starting point, wherein a distance from the starting point to an inner edge farthest from the seat is defined as a predetermined distance, and wherein the distance between the starting point and the projection point is equal to or less than ¾ of the predetermined distance.

5. The fan device according to claim 1, wherein the fan holder further includes a plurality of first connection members, a plurality of second connection members, and a plurality of support rods, wherein the first connection members are disposed on the frame, and each of the first connection members includes a first connection groove capable of being connected to any one of the support rods, wherein the second connection members are disposed on the seat, and each of the second connection members includes a second connection groove capable of being connected to any support rods, wherein when the frame and the bracket are at the storage position, the positions of the first connection members respectively correspond to the positions of the second connection members, and wherein each of the first connection grooves faces away from the seat, and each of the second connection grooves faces away from the frame.

6. A fan holder, comprising:

a bracket having a first end and a second end that is opposite to the first end;

four ratchet sets disposed on the bracket, wherein two of the four ratchet sets are disposed on the first end of the bracket, and the other two of the four ratchet sets are disposed on the second end of the bracket;

a seat connected to the two of the four ratchet sets disposed on the first end of the bracket, wherein the seat and the bracket have a first angle there-between; and a frame connected to the other two of the four ratchet sets disposed on the second end of the bracket, wherein the frame and the bracket have a second angle there-between, wherein the seat and the frame are rotatable between a use position and a storage position relative to the bracket through the four ratchet sets, wherein when the seat and the frame are rotated relative to the bracket from the use position toward the storage position, the seat and the frame are respectively rotated relative to the bracket along two opposite directions, so that each of the first angle and the second angle is gradually reduced from a maximum degree to a minimum degree, and wherein when the seat and the frame are at the storage position, each of the first angle and the second angle is equal to or less than 10 degrees;

wherein each of the four ratchet sets includes:

an abutment having two ends, wherein one of the two ends of the abutment is disposed on the bracket, and an outer edge of the other one of the two ends of the abutment has a plurality of single row ratchets;

a fastener having two ends, wherein one of the two ends of the fastener has an accommodating space and is pivotally connected to the abutment that is accommodated in the accommodating space, and wherein the other one of the two ends of the fastener is connected to the seat or the frame;

a gear arranged in the accommodating space and pivotally connected to the fastener, wherein the gear has a teeth end that is configured to be engaged with any one of the single row ratchets; and a torsion spring arranged in the accommodating space and pivotally connected to the fastener, wherein the torsion spring has two ends, wherein one of the two ends of the torsion spring abuts on the fastener, and the other one of the two ends of the torsion spring is hooked on the teeth end, and wherein the torsion spring pushes against the gear, so that the teeth end of the gear unidirectionally latches onto any one of the single row ratchets.

7. The fan holder according to claim 6, wherein each of the frame and the seat is a circular ring structure, and wherein when the frame and the bracket are at the storage position, a first projection region defined by orthogonally projecting the frame onto the seat has an outer contour that is substantially overlapped with an outer contour of the seat, and a second projection region defined by orthogonally projecting the bracket onto the seat has an outer contour that is arranged inside of the outer contour of the seat.

8. The fan holder according to claim 6, further comprising a plurality of first connection members, a plurality of second connection members, and a plurality of support rods, wherein the first connection members are disposed on the frame, and each of the first connection members includes a first connection groove capable of being connected to any one of the support rods, wherein the second connection members are disposed on the seat, and each of the second connection members includes a second connection groove capable of being connected to any support rods, wherein when the frame and the bracket are at the storage position, the positions of the first connection members respectively correspond to the positions of the second connection members, and wherein each of the first connection grooves faces away from the seat, and each of the second connection grooves faces away from the frame.

9. A fan holder, comprising:

a bracket having a first end and a second end that is opposite to the first end;

four ratchet sets disposed on the bracket, wherein two of the four ratchet sets are disposed on the first end of the bracket, and the other two of the four ratchet sets are disposed on the second end of the bracket;

a seat connected to the two of the four ratchet sets disposed on the first end of the bracket, wherein the seat and the bracket have a first angle there-between;

a frame connected to the other two of the four ratchet sets disposed on the second end of the bracket, wherein the frame and the bracket have a second angle there-between, wherein the seat and the frame are rotatable between a use position and a storage position relative to the bracket through the four ratchet sets, wherein when the seat and the frame are rotated relative to the bracket from the use position toward the storage position, the seat and the frame are respectively rotated relative to the bracket along two opposite directions, so that each of the first angle and the second angle is gradually reduced from a maximum degree to a minimum degree, and wherein when the seat and the frame are at the storage position, each of the first angle and the second angle is equal to or less than 10 degrees; and a plurality of first connection members, a plurality of second connection members, and a plurality of support rods, wherein the first connection members are disposed on the frame, and each of the first connection members includes a first connection groove capable of being connected to any one of the support rods, wherein the second connection members are disposed on the seat, and each of the second connection members includes a second connection groove capable of being connected to any support rods, wherein when the frame and the bracket are at the storage position, the positions of the first connection members respectively correspond to the positions of the second connection members, and wherein each of the first connection grooves faces away from the seat, and each of the second connection grooves faces away from the frame.

* * * * *